US005299989A

United States Patent [19]

Boyd et al.

[11] Patent Number: 5,299,989

[45] Date of Patent: Apr. 5, 1994

[54] ALL SURFACE TRAMPOLINE

[75] Inventors: Peter D. Boyd; Diane J. Boyd, both of Maui, Hi.

[73] Assignee: WaterTramps, U.S.A., Inc., Honolulu, Hi.

[21] Appl. No.: 786,589

[22] Filed: Nov. 1, 1991

[51] Int. Cl.[5] ..... A63B 5/11

[52] U.S. Cl. ..... 482/27; 182/139

[58] Field of Search ..... 482/27, 28, 29, 148, 482/23, 26, 77; 472/13, 128, 129, 135; 52/3-5; 182/139

[56] References Cited

U.S. PATENT DOCUMENTS

| | | | |
|---|---|---|---|
| 1,456,168 | 5/1923 | Witmer et al. . | |
| 2,173,963 | 9/1939 | Eubank | 9/11 |
| 3,080,584 | 3/1963 | Brown | 9/11 |
| 3,095,947 | 7/1963 | Beaulaurier | 182/139 |
| 3,130,816 | 4/1964 | Wright | 482/27 |
| 3,469,844 | 9/1969 | Sindelar | 273/105 |
| 3,734,496 | 5/1973 | Rubin | 482/27 |
| 4,139,192 | 2/1979 | McNeil | 482/27 |
| 4,162,062 | 7/1979 | Nissen et al. | 482/27 |
| 4,516,768 | 5/1985 | Gallaro | 272/65 |
| 4,576,375 | 3/1986 | Roberts | 272/65 |
| 4,598,904 | 7/1986 | Roth | 272/65 |
| 4,644,892 | 2/1987 | Fisher | 114/264 |

FOREIGN PATENT DOCUMENTS

| | | | |
|---|---|---|---|
| 1020677 | 2/1966 | United Kingdom | 272/65 |
| 2107201 | 4/1983 | United Kingdom | 272/65 |

*Primary Examiner*—Stephen R. Crow

*Attorney, Agent, or Firm*—Watson, Cole, Grindle & Watson

[57] ABSTRACT

An all surface trampoline comprising a hollow inflatible support having an inner and an outer periphery and having an open space between the inner periphery, an elastic trampoline mat suspended over the open space, and wherein a suspension device includes two layers of material extending around the periphery of the support with the mat sandwiched therebetween. The suspension device also extends around the outer periphery of the support and a layer of resilient material is disposed between the suspension device and the support adjacent the outer edge of the mat.

20 Claims, 5 Drawing Sheets

Fig. 3.
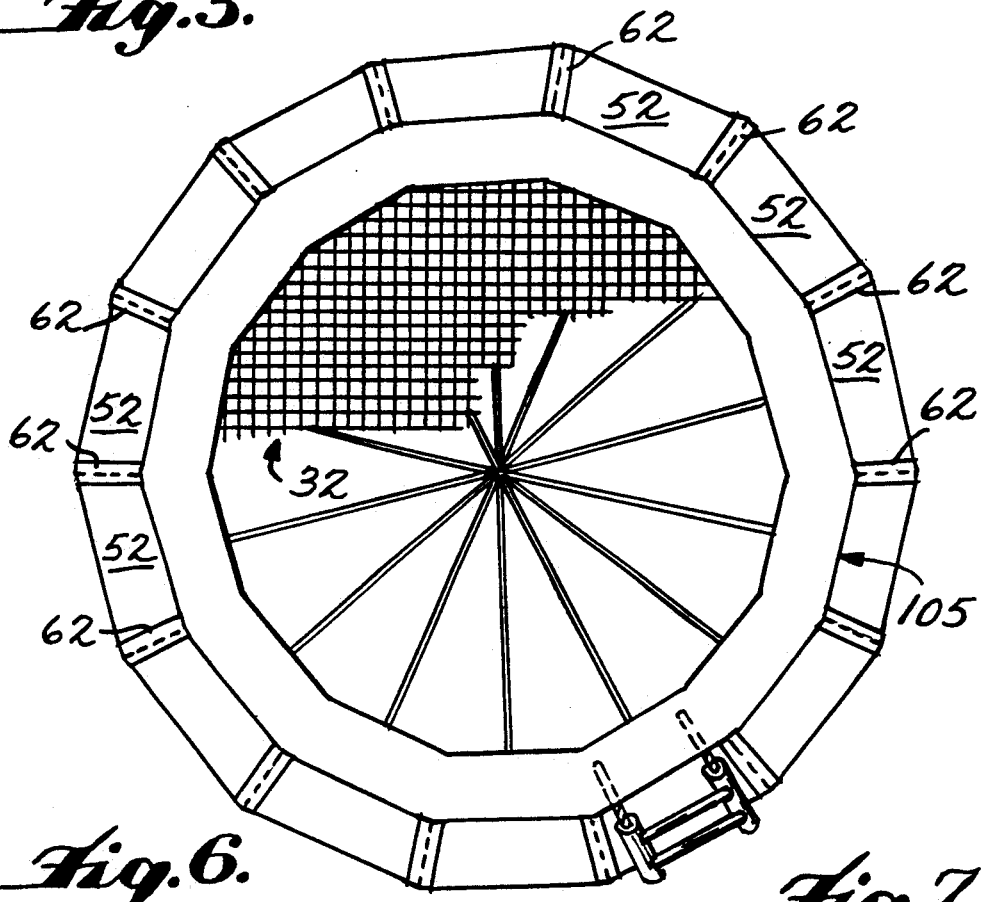
Fig. 6.
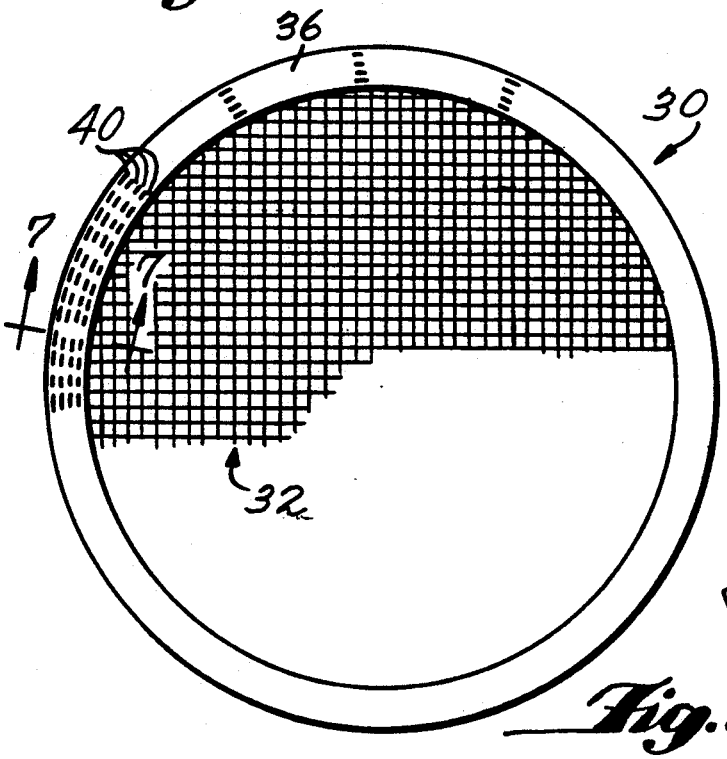
Fig. 7.
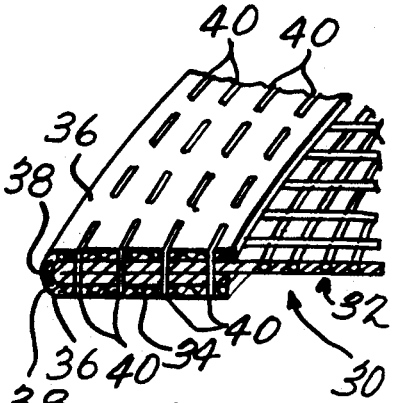
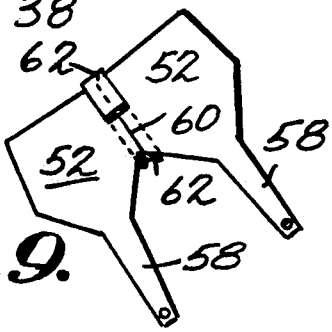
Fig. 9.

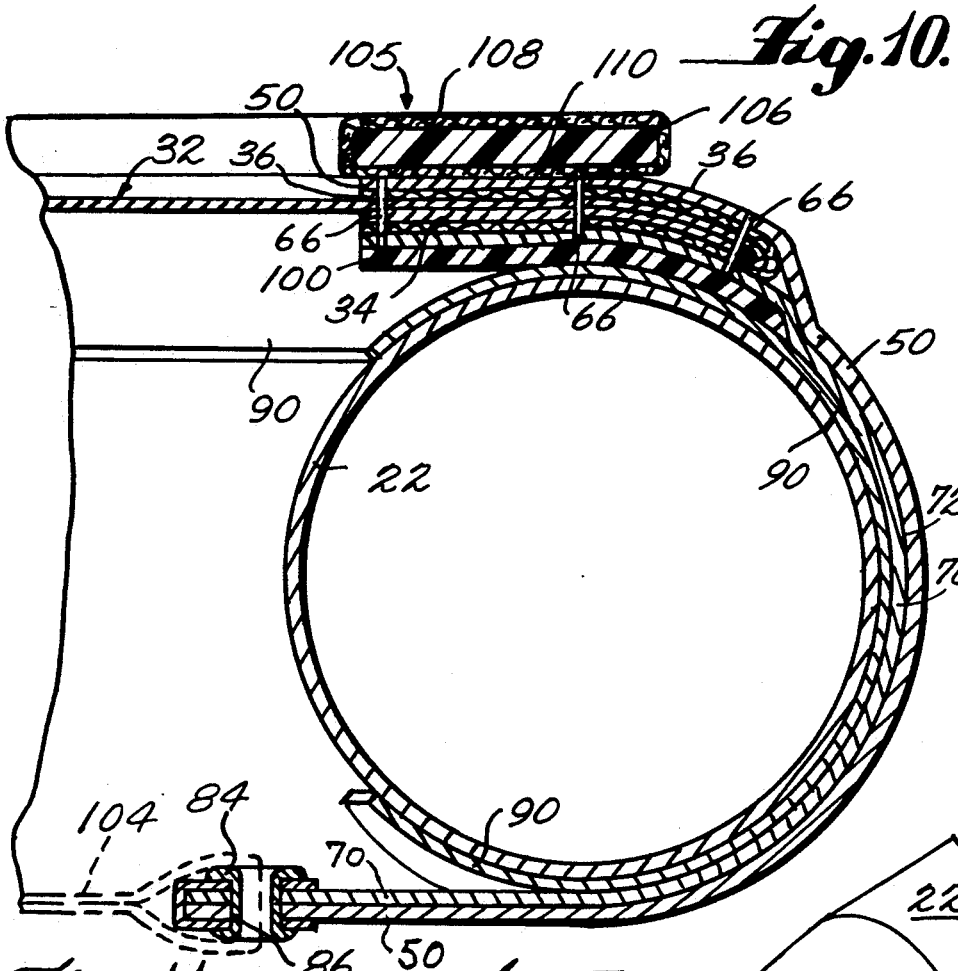
Fig.10.
Fig.11.
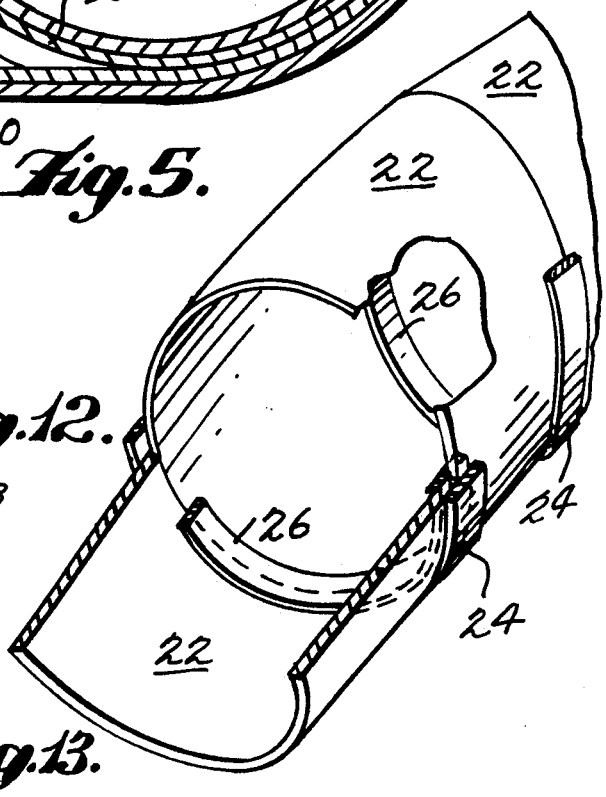
Fig.5.
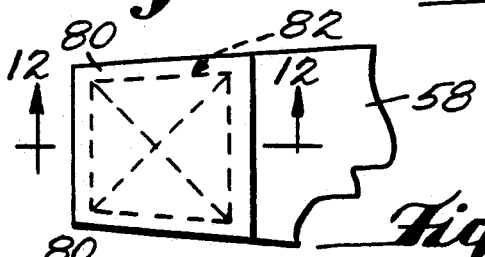
Fig.12.
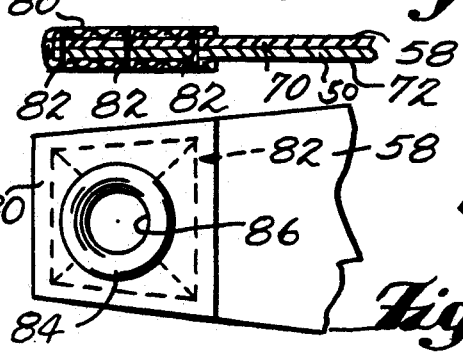
Fig.13.

ALL SURFACE TRAMPOLINE

CROSS-REFERENCE TO RELATED APPLICATION

The present application is related to and represents an improvement over our copending U.S. patent application Ser. No. 07/730,482, filed Jul. 16, 1991, pending the disclosure of which is incorporated by reference into this application.

BACKGROUND OF THE INVENTION

The invention relates to a trampoline which is adapted to be used on all types of surfaces, including both land and water surfaces. In the past, trampolines have been designed for use either on land or water, thereby limiting their use. It is therefore desirable to provide a trampoline which can be used on many different surfaces to increase its versatility.

A pneumatic trampoline designed specifically for use on land or a hard surface is shown in U.S. Pat. No. 3,130,816. In this arrangement, the pneumatic tube is deformed upon impact of a person jumping on the upper wall of the device, and the tube subsequently rebounds to provide lift to the jumper.

U.S. Pat. No. 4,576,375 discloses a trampoline specifically designed for use on water. A pneumatic tube is used to support the trampoline on water, and a base cover is attached to the lower interior of the tube to seal off rapid air flow through the tube opening and create a substantially closed volume between the base cover and the water surface.

The above prior art devices cannot be successfully employed on surfaces other than that for which they are specifically designed, and accordingly, the use thereof is limited. A problem existing with each of the foregoing discussed patented trampolines is that there is no provision for release of air pressure existing on the underside of the trampoline mat which is generated by jumpers using the trampoline. This air pressure will tend to distort the devices and cause them to move laterally. This of course will cause undesirable wear and tear on the bottom of a trampoline supported on land or other hard surface. In the case of a trampoline supported on water, water turbulence and waves will be generated thereby making the trampoline unstable.

A problem with constructions such as shown in U.S. Pat. No. 4,576,375 and our copending U.S. patent application Ser. No. 07/730,482, filed Jul. 16, 1991 is that they employ relatively heavy metallic components. These metallic components make the construction more expensive, and the weight of the metallic components increases the cost of transporting the device from one location to another. The metallic components also present a safety hazard since a jumper may be injured if he accidentally comes into contact with such components. Furthermore, assembly and disassembly of these constructions are difficult and time-consuming.

SUMMARY OF THE INVENTION

The present invention can be used on various surfaces such as snow, ice, mud, grass, soft ground, hard ground, water and ocean waves. Furthermore, the trampoline can be used in widely varying temperature environments ranging from freezing temperatures to more than 100 degrees Fahrenheit. The invention trampoline may be used by a skier to warm up before skiing where the trampoline is placed directly on the freezing snow. The trampoline can then be transported to a body of water such as a lake and used thereon the same day. At the ocean, the trampoline can be used either on the sand of the beach or on the incoming waves. It can also be set up in the back yard of a family's home on grass, dirt or gravel and the like.

The invention trampoline is designed to be of relatively large dimension, and in a typical example may have an outer diameter of about twenty feet and a tube diameter of about four feet. An inflatable support means in the form of a hollow ring-like configuration which provides a very stable construction which is adapted to support several different people at one time while a jumper is bouncing on the mat of the device.

In the present invention, air release means is provided in a most simple and effective manner. The trampoline mat is formed of a elastic material of open mesh construction forming holes of substantial size to provide an air release means which provides communication between the space below the mat and ambient air external of the trampoline. The air release means enables pressure on the underside of the mat, which is generated by jumpers using the trampoline, to be released to ambient air. In addition, the flow of air through the holes in the mat serves to cool the jumpers on a warm day.

The heavy and bulky metallic elements used in the prior art have been eliminated in the invention construction. The components of the invention device are formed of elastic and resilient plastic members. The trampoline mat is suspended in operative position by a suspension means including two layers of material which are spaced from one another at the upper portion thereof so that the outer edge of the mat is sandwiched therebetween and affixed thereto. The suspension means extends around the outer periphery of the support means, and securing means is connected to the lower portion of the suspension means for securing the the suspension means in operative position.

The securing means includes a plurality of connector elements each of which has the opposite ends thereof adjustably connected to spaced points of the lower portion of the suspension means. With this arrangement, the trampoline can be easily assembled and disassembled. There are no heavy and bulky metallic parts which could injure a jumper, and the device weighs significantly less than a similar device employing such metallic parts. The invention device is therefore more cost effective and easier to transport from one place to another.

A further important aspect of the securing means is the fact that the connector elements are adjustably connected to the lower portion of the suspension means so that the tension applied to the lower portions of the suspension means can be adjusted thereby adjusting the bounce performance of the trampoline. Accordingly, the bounce can readily be adjusted to the individual jumper by adjusting the tension applied to the lower portions of the suspension means in a very simple and effective manner.

A layer of resilient material is disposed between the inner surface of the suspension means and the support means so that the load produced by a jumper on the mat is distributed to the support means over a relatively wide area, this layer futher enhancing the bouncing effect of the trampoline. The distribution of the load prevents excessive wear in localized areas, and the bouncing effect of the trampoline is substantially increased by this layer of resilient material.

The invention trampoline provides a unified structure which in effect acts like one giant spring, thereby providing good operating characteristics. The construction is very compact and employs a minimum of components.

A novel means is also provided for supporting a ladder on the trampoline in such a manner that the ladder will be retained in the proper position with respect to the trampoline

BRIEF DESCRIPTION OF THE DRAWINGS

FIG. 3 is a top view partly broken away of the trampoline shown in FIG. 1;

FIG. 5 is an enlarged top perspective view of a portion of the support means shown in FIG. 5 partly in section and partly broken away;

FIG. 6 is a top view partly broken away showing the mat of the device;

FIG. 7 is an enlarged sectional view taken on the line 7—7 of FIG. 6;

FIG. 9 is top perspective view partly broken away showing a portion of the suspension means;

FIG. 10 is an enlarged sectional view through one side of the trampoline;

FIG. 11 is a top view of a lower portion of the suspension means showing an intermediate step in the manufacture thereof;

FIG. 12 is a sectional view taken along line 12—12 of FIG. 11;

FIG. 13 is a view similar to FIG. 11 showing the lower portion of the suspension means after the manufacture thereof is completed.

DESCRIPTION OF THE PREFERRED EMBODIMENT

Figure 4:
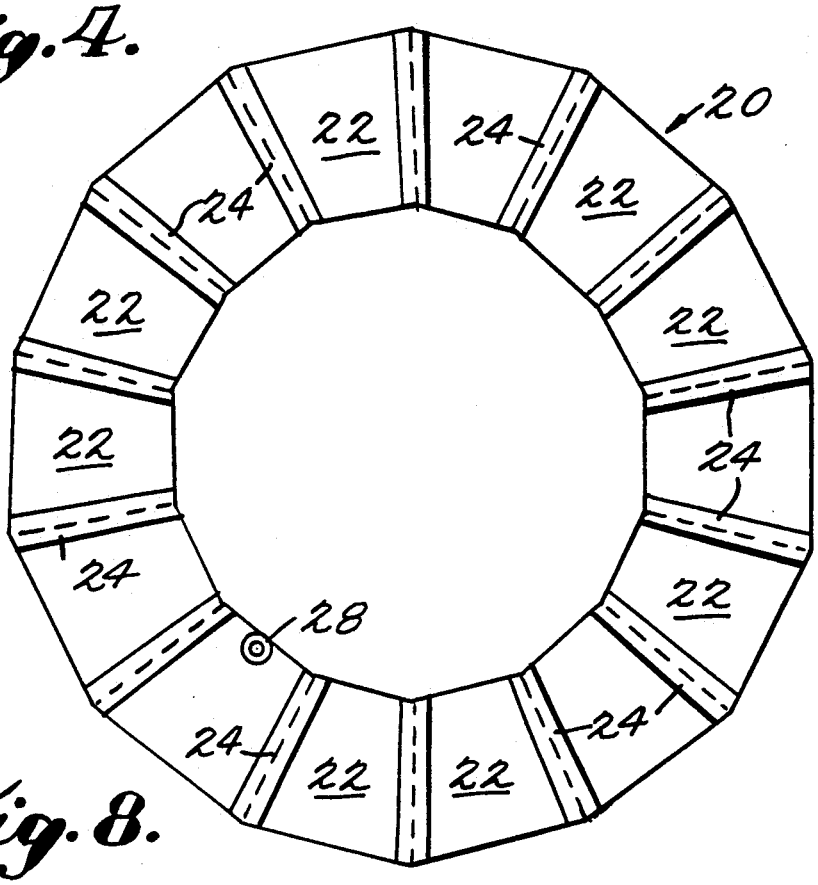
FIG. 4 is a top view of the support means of the invention.

Referring now to the drawings wherein like reference characters designated corresponding parts throughout the several views, a support means is indicated generally by reference numeral 20 in FIG. 4 and is formed of fourteen similar members 22 each of which has the configuration of a hollow truncated cylinder. Members 22 are formed, for example, of polyester reinforced PVC or any similar plastic substance which is relatively rugged and waterproof.

As seen in FIG. 5, members 22 are connected to one another in end-to-end relation and are suitably sealed with respect to one another. These ends may be heat sealed to one another and/or sealed by strips 24 and 26 formed of similar material which overlap the seam between members 22 and which are heat sealed to the adjacent ends of members 22. It will be noted that strips 24 extend around the outer surfaces of adjacent members 22 and strips 26 extend around the inner surfaces of members 22.

The assembled support means 20 as seen in FIG. 4 is generally ring-shaped in configuration, and an air filling valve 28 is provided on the inner periphery of the support means for inflating and deflating the support means when desired.

As seen in FIGS. 6 and 7, the trampoline mat 30 includes a one-piece circular jumping mat 32 formed of an elastic material such as Nylon or an elastic vinyl encapsulated polyester substance and the like is woven to as to provide an open mesh construction forming holes of substantial size. For example, the holes are shown as being of substantially square construction and may have a dimension of between about one-quarter inch and one-half inch on a side. This size of hole is such that a jumper's toes do not go through or get caught in the holes of the mat, thereby providing a satisfactory jumping surface. At the same time, the holes provide an air release means providing communication between the space below the mat and ambient air external of the trampoline so that pressure on the underside of the mat which is generated by jumpers using the trampoline will be adequately released to ambient air to provide successful bounce performance by the trampoline. It should be noted that a substantial portion of the entire area of the mat comprises holes to provide an air release means. If the mat were not provided with such holes, the trampoline would not function in a proper manner.

As seen in FIG. 7, the outer edge of the mat 32 is folded upon itself to provide a folded portion 34. The outermost edge of the mat may be provided with radially extending slits or "darts" so as to prevent the folded under portion from wrinkling or bunching up. A reinforcing means is attached to the folded portion and comprises a pair of annular strips 36 formed of DACRON or similar material, the outer edges of which are provided with lips 38 extending over the outermost edge of the folded portion. The strips 36 are attached to the folded portion 34 by four annular lines of stitching 40 which extend all the way around strips 36. Only a portion of this stitching is shown in FIG. 6 for the sake of simplicity.

Figure 8:
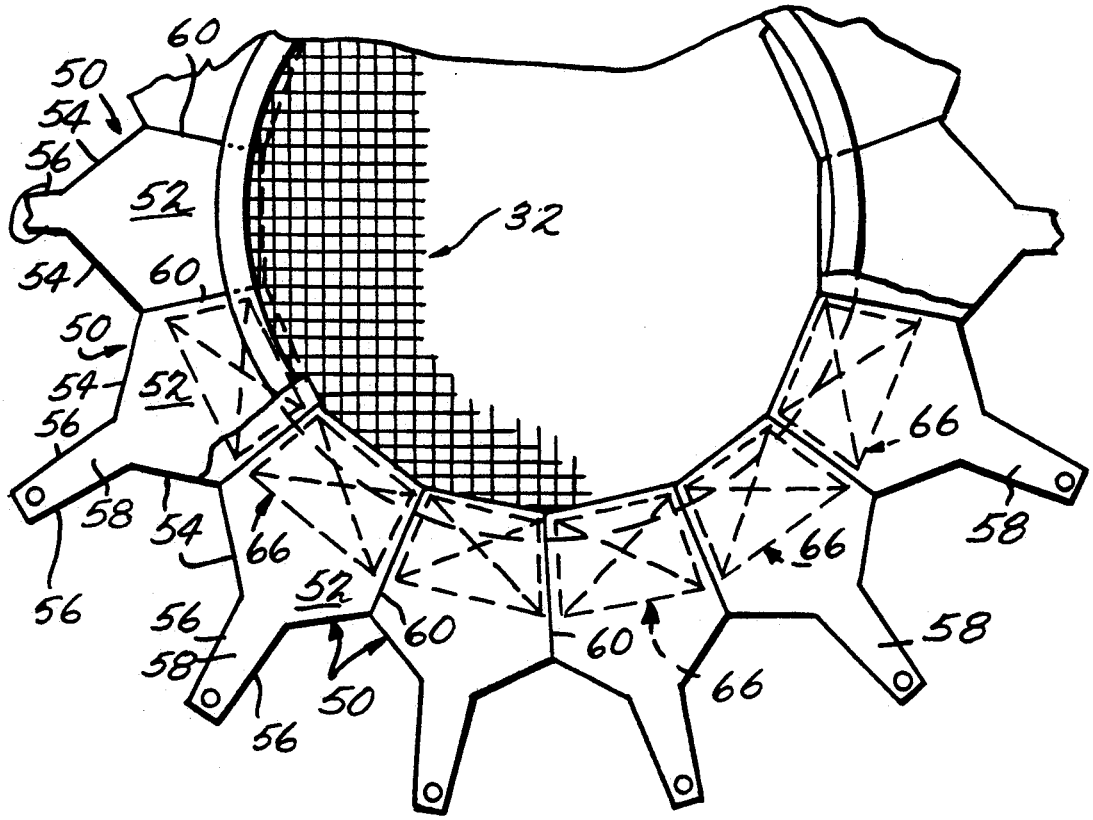
FIG. 8 is a top view of a portion of the suspension means with certain parts removed for the sake of clarity.

As seen in FIG. 8, a suspension means for suspending the mat over the space defined within the support means includes an upper layer 50 which comprises fourteen members formed of polyester reinforced PVC and which are connected to one another. These fourteen members overlie the upper surface of the support means and which extend around the members 22 of the support means. Each of the fourteen members comprising layer 50 includes an upper portion 52 which has the same configuration as the upper portion of each of members 22 of the support means. Each of portions 52 includes sloping edges 54 which join with sloping edges 56 defining a tapered lower portion 58 of the suspension means. There are, of course, fourteen lower portions 58.

Upper portions 52 of the fourteen members comprising the upper layer 50 of the suspension means are secured to one another along abutting side edges 60. As seen in FIG. 9, side edges 60 are secured to one another by heat sealing and/or by providing strips 62 of similar material which overlap edges 60 and which are heat sealed to the the adjacent portions 52. As seen in FIG. 8, strips 62 are removed for the sake of clarity. The portions 52 are attached to the reinforced outer edge of the mat by the stitching pattern 66.

As seen in FIG. 10, the suspension means includes a second layer 70 formed of a nonabrasive PVC and being of similar configuration to layer 50. Layer 70 is also formed of fourteen members having the same configuration as the fourteen members forming layer 50. Each member of layer 70 is adhesively secured to a corresponding member of layer 50 as indicated at 72 along the major portion of the length of these members. All elements which are adhesively secured to one another in the invention are adhesively secured to one another by a suitable marine glue which is waterproof such as a two part glue and hardener adhesive sold under the name of ZODIAC manufactured by Zodiac, 58, Boulevard Gallieni, 92137 Issy-Les-Moulineaux Cedex, France.

At the upper portions of each of the layers 50 and 70, the layers are spaced from one another with the outer edge of the trampoline mat sandwiched therebetween. The stitching pattern shown in FIG. 8 extends through both layers as well as the reinforced outer edge of the mat to define the lines of stitching 66 as seen in FIG. 10, it being understood that FIG. 10 is a section taken along a radial line bisecting one of the stitching patterns as shown in FIG. 8. In order to additionally secure the outer edge of the mat within the two layers, these components may also be secured to one another by marine glue as described above.

The lowermost ends of the tapered portions of the suspension means are provided with means for securing connector elements thereto. As seen in FIGS. 11–13, the lowermost end 58 of layer 50 is shown as being adhesively attached to the lowermost end of layer 70. These lowermost ends are reinforced by a sheet of nylon webbing 80 which is wrapped around these lowermost ends and which is attached thereto by a stitching pattern 82. After this reinforcement is stitched in place, a hole is formed in the lowermost ends and a stainless steel grommet 84 is secured within the hole in a conventional manner. The grommet is provided with the usual hole 86.

Figure 1:
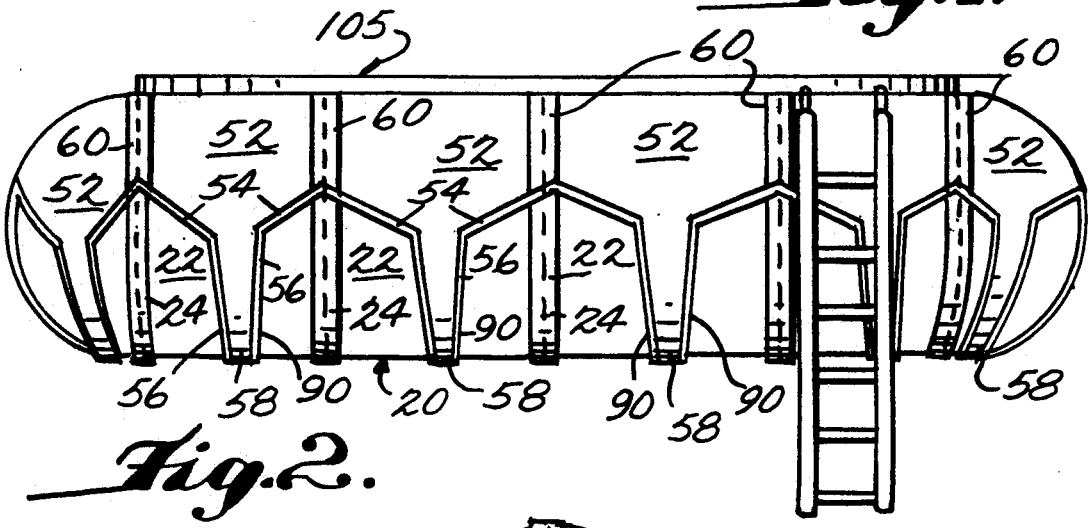
FIG. 1 is a side view of a trampoline according to the present invention.

As seen in FIG. 10, a protective layer of material 90 formed of nonabrasive PVC is adhesively secured to the outer surface of the support means. There is a protective layer 90 corresponding to each of the fourteen members of layers 50 and 70, each layer 90 being of similar configuration to the members forming each of layers 50 and 70, but being of slightly larger dimension. The layers 90 each have edges which extend about one inch beyond edges 54 and 56, as seen most clearly in FIG. 1. Accordingly, if there is relative movement between the suspension means and the support means during jumping activity, the larger size of the layers 90 will prevent the lower layer 70 of the suspension means from rubbing directly on the outer surface of support member 22.

A layer of resilient material 100 is adhesively secured to the inner surface of layer 70 of the suspension means. This layer is formed of expanded plastic foam material such as closed cell expanded polyethylene foam. It will be noted that the outer edge of the mat is disposed in overlying relationship to a portion of the supporting means, and the layer 100 is disposed in overlying relationship to substantially the same portion of the supporting means. Layer 100 is of annular configuration, extending completely around inner surface of the upper portion of the suspension means and serves to distribute the load produced by a jumper on the mat to the support means and also enhances the bouncing effect of the trampoline. It will be noted that if the mat causes the upper end of the suspension means to move downwardly relative to the support means, additional portions of layer 100 may come into contact with layer 90 therebeneath.

Figure 2:
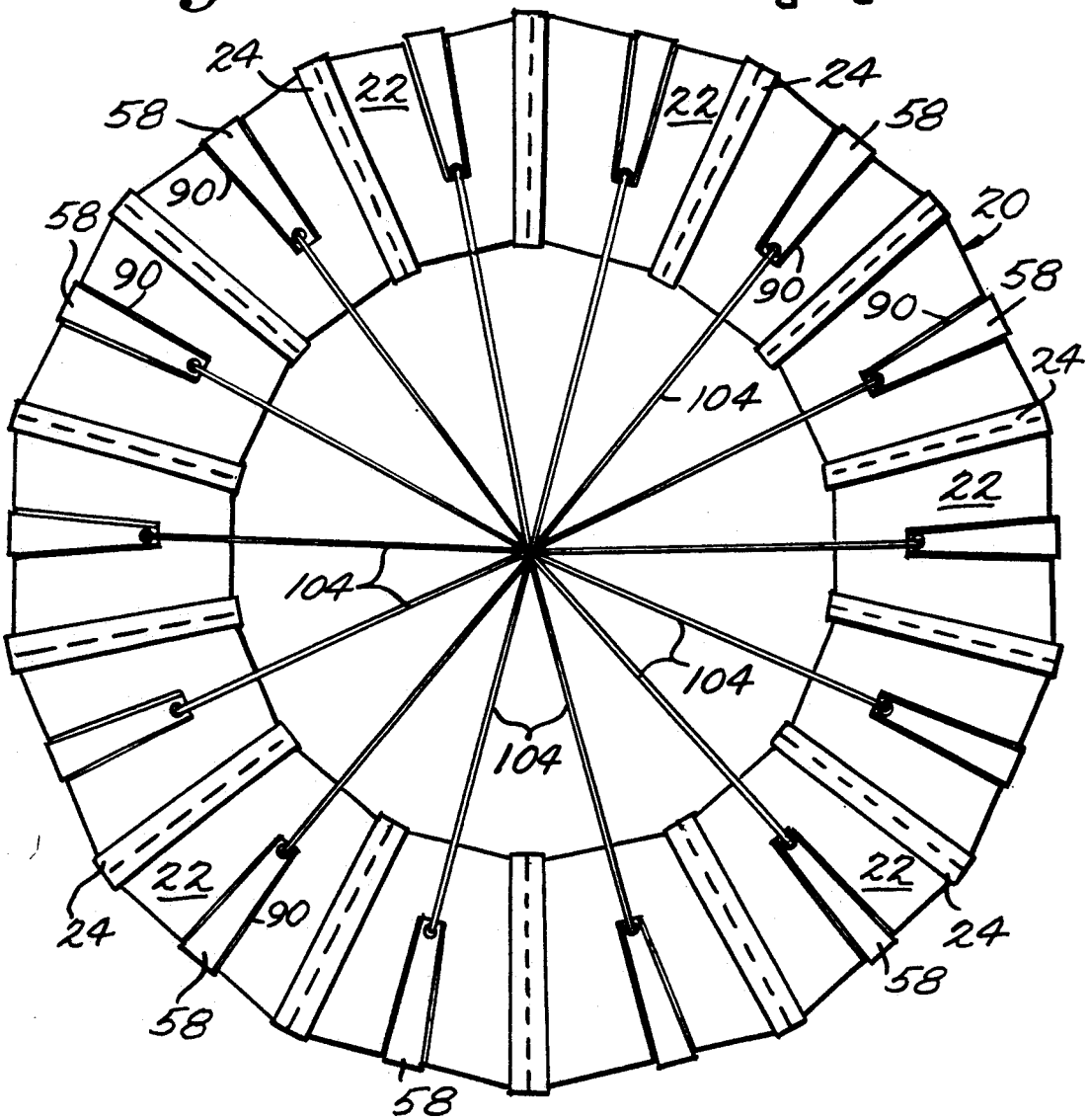
FIG. 2 is a bottom view of the trampoline shown in FIG. 1.

As seen in FIG. 2, securing means is provided for applying and adjusting tension to the lower portions of the suspension means and includes a plurality of similar connector elements 104 in the form of ropes or the like which are substantially nonelastic and which will not substantially deform in a lengthwise direction during use. The opposite ends of each rope 104 are connected to the grommets 86 in one of the lowermost ends of the lower portion of the suspension means. Accordingly, seven ropes are provided, each rope having its opposite ends adjustably connected to spaced points of the suspension means which are substantially diametrically opposite to one another.

The ends of the ropes are tied to the lower ends of the suspension means using suitable knots is a well-known manner. It is apparent that the tension applied to the lower ends of the suspension means may be increased by adjusting the ropes 104 to pull the lowermost ends of the suspension means toward one another. Similarly, the tension may be decreased by allowing the lowermost ends of the suspension means to move further apart. In this manner the tension and the bounce of the mat may be adjusted in a simple and effective manner.

When assembling the trampoline, the support means is inflated to about eighty-five percent of its normal pressure. The ropes 104 are then tied to the lower ends of the suspension means and the tension adjusted on the suspension means for the desired bounce performance. After all the ropes are tied to give the desired tension, the support means is inflated to one-hundred percent of its normal pressure and the device is ready for use.

As seen in FIG. 10, a pad 105 formed of a body of resilient material 106 such as expanded polyethylene is provided, this pad being surrounded by a cover 108 formed of lightweight vinyl or Dacron and the like. In a typical example, the pad may be about one inch thick and have a width of about one and one-half feet. The pad is attached to the upper surface of layer 50 of the suspension means by adhesive means indicated at 110. This pad is generally annular in configuration, extending completely around the upper portion of the trampoline and serves as a place where persons can sit down when not jumping on the mat. The mat could also be formed of a material sold commercially under the name of ASTRODECK which is a soft layer of neoprene material preglued to have a sticky surface which can be secured to the upper surface of layer 50.

Figure 14:
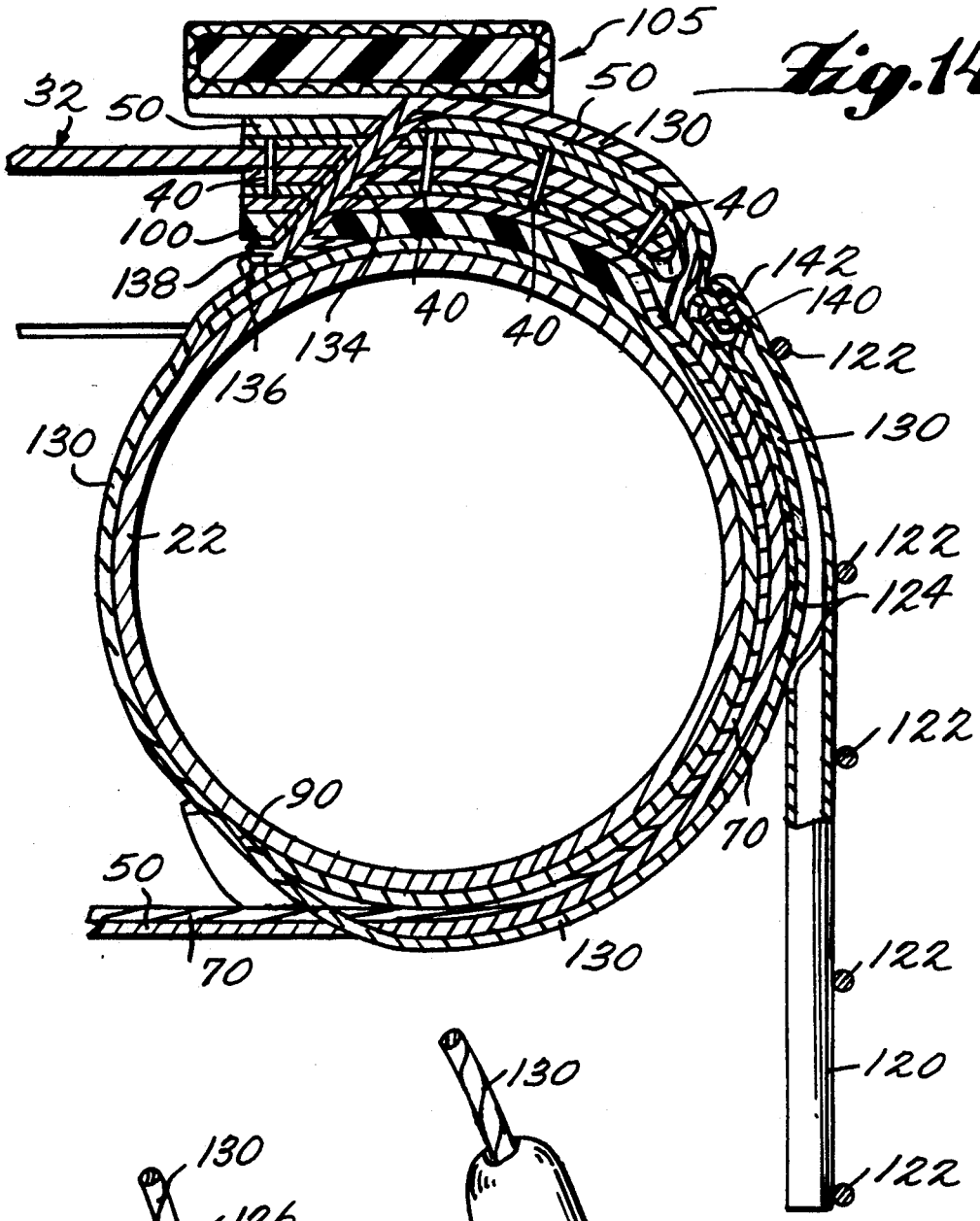
FIG. 14 is an enlarged sectional view through a side of the trampoline where the ladder is supported.
Figure 15:
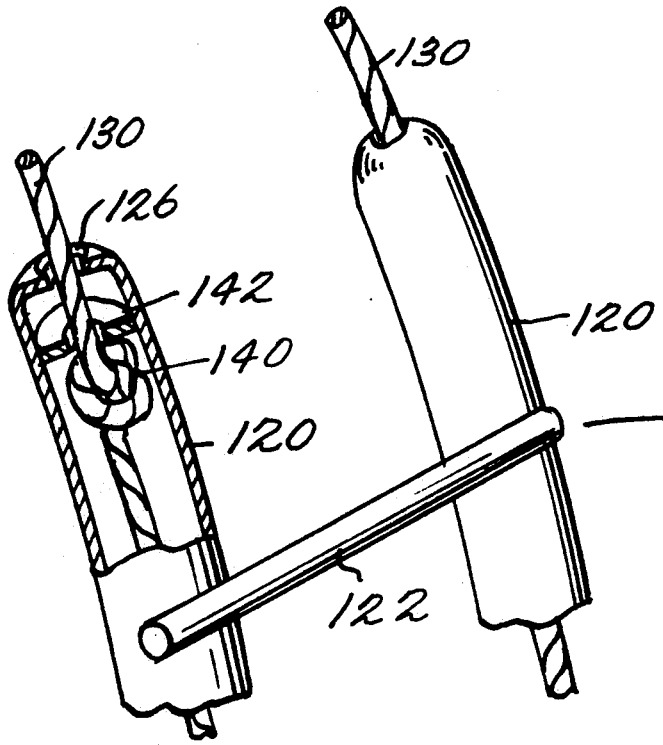
FIG. 15 is a top perspective view partly broken away showing the upper end of the ladder.

Referring now to FIGS. 14 and 15 of the drawing, a ladder and the means of supporting it in position are shown. Since FIG. 14 is a section different from that of FIG. 10, the four lines of stitching 40 which attach the jumping mat to the reinforcing means at the outer edge thereof are shown in FIG. 14. The nonabrasive layer 90 adjacent the ladder may be modified, if so desired, to completely cover the associated section 22 of the support means to prevent damage to the support means by the ladder.

The ladder includes a pair of spaced hollow risers 120 having rungs 122 suitably connected therebetween in the usual manner. The risers are of similar construction, so a description of one will suffice for both. Each of the risers has an elongated hole 124 formed at an intermediate point thereof and another hole 126 formed at the upper end thereof. A pair of identical flexible elements 130 in the form of ropes are provided for holding the ladder in place. Each rope passes outwardly through the upper hole in the associated riser and lies over the layer 50 of the suspension means. The pad 105 is glued directly to the layer 50 except for those places where the ropes pass between the pad and layer 50. Alternatively, the pad may be provided with channels in the undersurface thereof to receive the ropes.

The ropes then pass downwardly through a stainless steel grommet 134 provided through the upper portion of the suspension means. Layers 50 and 70 may be provided with reinforcement in the form of Nylon webbing stitched in place adjacent grommets 134. A knot 136 is tied in each rope and a stainless steel washer is mounted on the rope adjacent the knot to prevent the rope from pulling upward through grommet 134. Each rope then passes downwardly engaging the inner periphery of the support member 22. Each rope then passes around the undersurface of the support member and upwardly through hole 124 formed in the associated riser. Each rope then extends upwardly within the riser and has a second knot 140 formed therein. Either of the two knots formed in each rope may be formed by the opposite ends of the rope. A washer 142 is mounted on each rope adjacent knot 140 to prevent the rope from pulling upwardly through hole 126 in the riser.

It will be noted that the flexible elements or ropes 130 are disposed in surrounding relationship to the support means. The knots 136 and 140 form enlargements on each of the flexible elements, and the washers serve as limiting means for limiting movement of the flexible elements.

The invention has been described with reference to a certain embodiment. Obviously, modifications, alterations and other embodiments will occur to others upon reading and understanding this specification. It is our intention to include all modifications, alterations and alternate embodiments insofar as they come within the scope of the appended claims or the equivalent thereof.

What is claimed is:

1. An all surface trampoline comprising a hollow inflatable support means having an inner periphery and an outer periphery, said inner periphery defining a space therewithin, means for inflating said support means with air, an elastic trampoline mat having an outer edge, suspension means for suspending the mat in operative position over said space, said suspension means having an upper portion and a lower portion and an inner surface, said suspension means including two layers of material, said two layers being spaced from one another at said upper portion of the suspension means and having said outer edge of the trampoline mat sandwiched therebetween, means for fixedly securing said outer edge to said two layers at said upper portion, said two layers extending around the outer periphery of said support means, and securing means for securing the lower portion of said suspension means in operative position.

2. A trampoline as defined in claim 1 wherein said securing means includes means for applying and adjusting tension to the lower portions of said suspension means for adjusting the bounce of said mat.

3. A trampoline as defined in 2 wherein said securing means includes connecting means for connecting spaced points of said lower portion of the suspension means to one another.

4. A trampoline as defined in claim 3 wherein said connecting means includes a plurality of connector elements each of which has the opposite ends thereof adjustably connected to spaced points of the lower portion of said suspension means.

5. A trampoline as defined in claim 1 including a layer of resilient material disposed between said inner surface of the suspension means and said support means to distribute the load produced by a jumper on said mat to the support means and to enhance the bouncing effect of the trampoline.

6. A trampoline as defined in claim 1 including reinforcing means disposed at said outer edge of the mat, and means attaching said reinforcing means to said mat.

7. A trampoline as defined in claim 1 including stitching means securing said upper portion of the suspension means to said outer edge of the mat.

8. A trampoline as defined in claim 1 including adhesive means securing said upper portion of the suspension means to said outer edge of the mat.

9. A trampoline as defined in claim 1 including a protective layer of material disposed between said support means and said inner surface of the suspension means.

10. A trampoline as defined in claim 1 including reinforcing means disposed at said lower portion of said suspension means, said securing means being connected to said lower portion adjacent said reinforcing means.

11. A trampoline as defined in claim 1 including a resilient pad secured to said upper portion of the suspension means and disposed in overlying relationship thereto.

12. A trampoline as defined in claim 1 including ladder means supported by said suspension means, said ladder means being supported by a pair of flexible elements, said flexible elements being disposed in surrounding relationship to said support means and being operatively connected to said ladder means.

13. A trampoline as defined in claim 12 wherein said ladder means includes a pair of hollow riser means, each riser means having a pair of spaced holes formed therein in communication with the hollow interior of the associated riser means, each of said flexible elements passing through said holes, and limiting means for limiting movement of said flexible elements.

14. A trampoline as defined in claim 13 wherein said limiting means includes an enlargement on each of said flexible elements, and washer means engaging said enlargements.

15. A trampoline comprising a hollow inflatable support means having an inner periphery and an outer periphery, said inner periphery defining a space therewithin, means for inflating said support means with air, an elastic trampoline mat having an outer edge, suspension means connected to said outer edge of the trampoline mat for suspending the mat in operative position over said space, said suspension means including an inner and an outer surface, said inner surface of the suspension means extending around said outer periphery of the support means, and a layer of resilient material being secured to and movable with said inner surface of the suspension means and disposed between said inner surface of the suspension means and said support means adjacent said outer edge of the mat to distribute the load produced by a jumper on said mat to the support means and to enhance the bouncing effect of the trampoline.

16. A trampoline as defined in claim 15 wherein said outer edge of the mat is disposed in overlying relationship to a portion of said supporting means, said layer of resilient material being disposed in overlying relationship to substantially the same portion of said supporting means.

17. A trampoline as defined in claim 15 wherein said layer of resilient material comprises an expanded plastic foam material.

18. A trampoline as defined in claim 6 wherein said outer edge of the mat is folded upon itself to form a folded portion, and said reinforcing mean is attached to said folded portion.

19. A trampoline as defined in claim 1 wherein said trampoline mat is formed of an open mesh construction forming holes of substantial size to provide an air release means providing communication between said space and ambient air external of the trampoline so that pressure on the underside of the mat which is generated by jumpers using the trampoline will be released to ambient air.

20. A trampoline as defined in claim 15 wherein said trampoline mat is formed of an open mesh construction forming holes of substantial size to provide an air release means providing communication between said space and ambient air external of the trampoline so that pressure on the underside of the mat which is generated by jumpers using the trampoline will be released to ambient air.

* * * * *